United States Patent [19]

Edgworth et al.

[11] 4,106,569

[45] Aug. 15, 1978

[54] APPARATUS FOR APPLYING AN IMPACT FORCE

[75] Inventors: Harry Edgworth, 35a Broad Oaks Rd., Solihull, West Midlands, England; Frederick Edgworth, Solihull, England

[73] Assignee: Harry Edgworth, England

[21] Appl. No.: 655,906

[22] Filed: Feb. 6, 1976

[30] Foreign Application Priority Data

Feb. 14, 1975 [GB] United Kingdom ..... 6248/75

[51] Int. Cl.[2] ..... E02D 7/18

[52] U.S. Cl. ..... 173/1; 173/49; 173/122

[58] Field of Search ..... 173/1, 49, 122, 123, 173/124; 259/91, DIG. 42, 1; 74/62, 89.1; 198/25; 185/27, 29, 32, 33; 254/29 R; 175/56; 73/12

[56] References Cited

U.S. PATENT DOCUMENTS

| | | | |
|---|---|---|---|
| 58,880 | 10/1866 | Noyes | 173/122 |
| 2,475,614 | 7/1949 | Hoppmann et al. | 73/12 |
| 2,660,880 | 12/1953 | Vivian | 73/12 |
| 2,937,865 | 5/1960 | Patterson | 73/12 |
| 3,946,598 | 3/1976 | Towne et al. | 73/12 |

*Primary Examiner*—Robert Hafer

*Attorney, Agent, or Firm*—Merriam, Marshall & Bicknell

[57] ABSTRACT

A pile driver in which a weight is reciprocated in a frame along a vertical path. The weight is suddenly retarded just before the weight reaches its lowermost position and the resulting high force is transmitted to the pile without an impact occurring. In one embodiment, the weight is connected to the frame by two pivotal links and these links are used to retard the weight. In another embodiment, the weight is driven upwardly and retarded by a cam mounted on a drive shaft.

14 Claims, 3 Drawing Figures

18
16

14
20
-22-
24
24
28
29
V
27
26
25
P
10
12

APPARATUS FOR APPLYING AN IMPACT FORCE

BACKGROUND OF THE INVENTION

The present invention relates to apparatus and a method for applying a high force to an object.

The invention is primarily intended for use with pile driving apparatus but may also be used with other apparatus for applying a high force to an object, such as drop forging apparatus or concrete breaking apparatus.

Apparatus for applying a high force usually comprises a weight and a driving member, the weight being raised above the driving member and then allowed to fall onto the driving member thereby applying an impact force thereto.

A disadvantage encountered with such apparatus is that an undesirably loud noise is created by the impact between the driving member and the weight.

It is accordingly an object of the present invention to provide a new or improved apparatus for applying an impact force.

SUMMARY OF THE INVENTION

According to one aspect of the present invention, there is provided an apparatus for applying a high force to an object, such apparatus comprising a frame, a driving member mounted on the frame and adapted to engage the object, a weight mounted on the frame for reciprocating movement relative thereto, and means for causing the weight to perform reciprocating movement including means to cause sudden retardation of the weight at one stage during each complete reciprocation, and the high force arising from the sudden retardation being transmitted from the weight to the driving member without impact, as herein defined.

The high force may be transmitted along a path which passes solely through solid members, the solid members being in engagement with each other, the weight and the driving member at least immediately prior to and for the duration of the sudden retardation.

According to another aspect of the present invention, there is provided a method for applying a high force to an object comprising reciprocating a weight, suddenly retarding the weight at one stage during each complete reciprocation and transmitting the high force resulting from the sudden retardation from the weight to the object without impact, as herein defined.

BRIEF DESCRIPTION OF THE DRAWINGS

The present invention is illustrated in the accompanying drawings wherein:

Referring now to FIG. 1, the pile driver there illustrated comprises a driving member 10 engaging the top of a pile 12.

Figure 1:
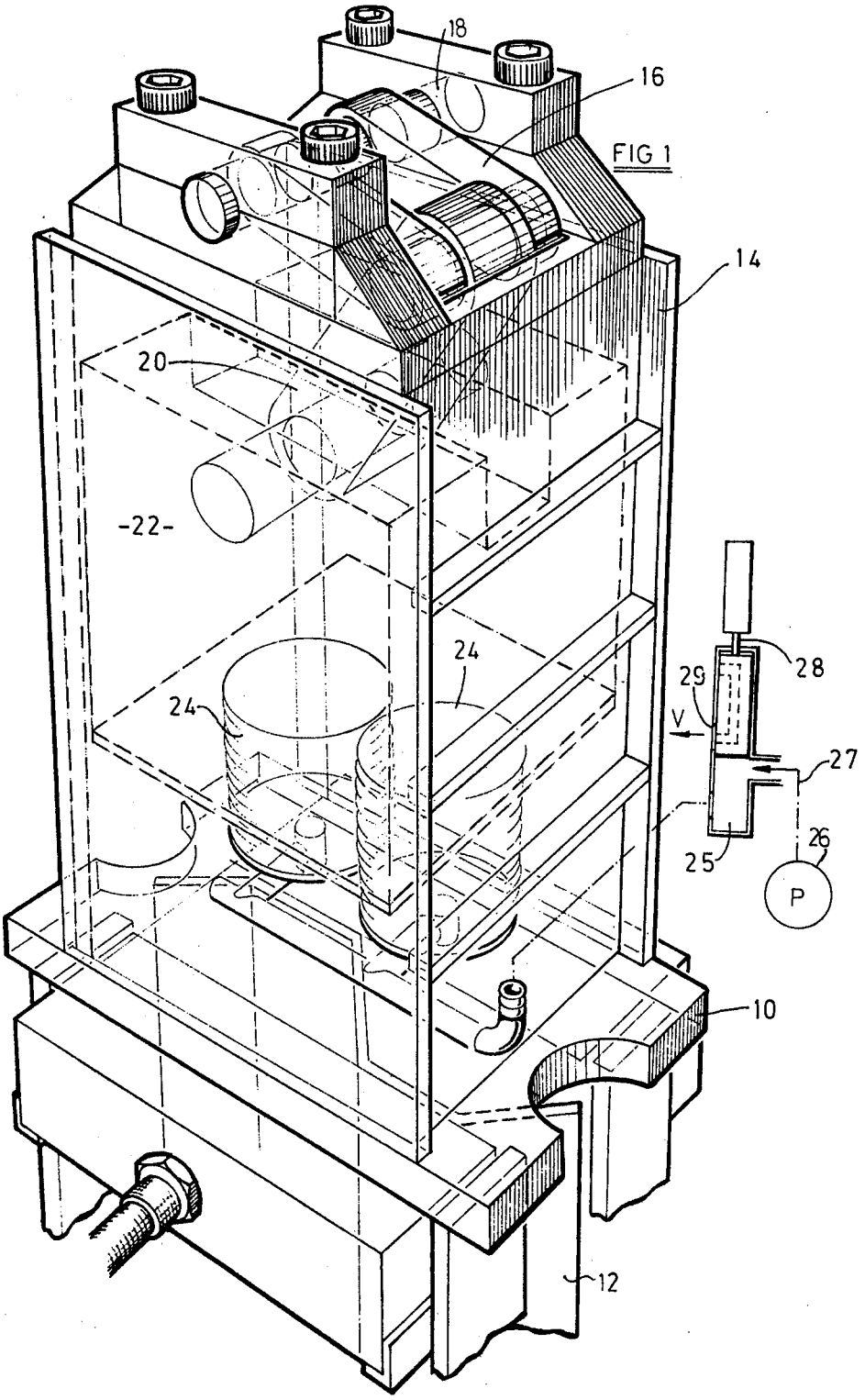
FIG. 1 is a perspective view of a pile driver of one embodiment of the present invention.

Extending upwardly from and attached to the driving member 10 is a frame member 14.

A pair of links 16 are pivotally connected to a cross member 18 mounted on the top of the frame 14 and these links 16 are pivotally connected to a further link 20 which in turn is pivotally connected to a weight 22.

The weight 22 is mounted for reciprocating movement in the frame 14 and is driven upwardly by bellows 24 which are operated by compressed air.

The compressed air supply to the bellow 24 is controlled by valve 25 which in turn is supplied with compressed air from a source 26 through a conduit 27.

The valve 25 permanently connects the bellows 24 to the conduit 27 but includes a valve member 28 which, when operated, connects the bellows to the atmosphere through a number of holes 29 thereby rapidly reducing the pressure in the bellows to a pressure approaching atmosphere and permitting the weight to descend.

The valve member is servo-operated by further valves, not shown, which are operated by movement of the weight 22. These further valves are vertically spaced and are arranged so that one valve causes the connection to the atmosphere to be closed when the weight reaches its lowest position thereby causing the weight to be raised and another valve causes the connection to be opened when the weight has been raised through a predetermined height thereby allowing the weight to descend. The valves are arranged so that it is possible to select which valve causes the connection to be opened so that it is possible to vary the height through which the height is raised.

In operation for driving the pile 12, the weight 22 is driven upwardly by the bellows 24 and is then upon operation of the valve member 28 permitted to fall downwardly under the influence of gravity. During the last part of the downward movement of the weight 22, the weight 22 will be suddenly retarded by the action of the links 16 and 20.

As a result of the sudden retardation of the weight 22 and the associated sudden change in momentum, a force will be transmitted from the weight 22 through the links 16 and 20 and the frame 14 to the driving member 10 and then to the pile 12. Providing the resistance to being driven into the ground is not excessively high, the pile 12 will thus be driven as a result of receiving the high force.

Reciprocation of the weight 22 will then continue until the pile 12 has been driven into the ground by the desired amount.

The weight 22 can be reciprocated at speeds up to 100 reciprocations per minute and it is considered that speeds up to 200 reciprocations per minute might be possible.

As may be appreciated, very little noise will be generated by the pile driver and the usual noise associated with a conventional pile driver caused by a weight hitting the driving member of the pile driver will be absent.

The weights shown in FIG. 1 has a mass of 5 metric tonnes and may be raised through a maximum height of 500 mm. The links 16 and 20 are designed to have a breaking strength in excess of 2080 metric tonnes force and the distances between the pivoted connections on the links 16 and 20 are 735 mm and 457 mm., respectively.

Figure 2:
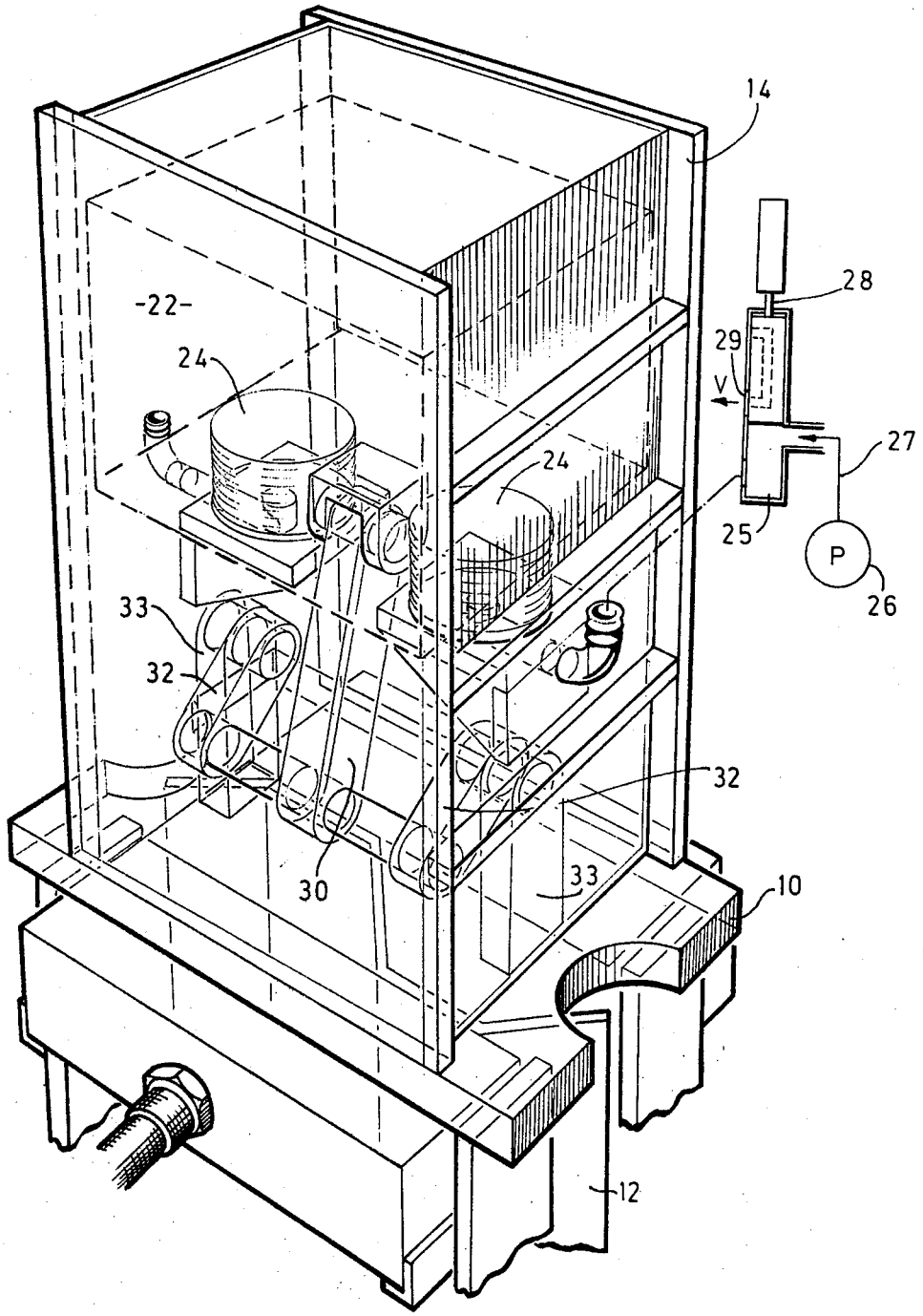
FIG. 2 is a perspective view of a pile driver of another embodiment of the present invention.

In the embodiment of the invention shown in FIG. 2, the general arrangement of the parts is the same as shown in FIG. 1 and like parts have been denoted by the same reference numerals. However, in this embodiment, in place of the links 16 and 20 a link 30 is pivotally attached to the unerside of the weight 22 and is also pivotally attached to two further links 32 which are pivotally attached to pillars 33 attached to the driving member 10.

This embodiment has the advantage that the link 30 will be in compression whilst the high force is being transmitted with the result that this link may be of a smaller cross-section than the link 20 of the embodiment shown in FIG. 1.

The pile driver shown in FIG. 1 can be further modified to achieve other embodiment of the present invention.

For example in other embodiments of the present invention, the weight is raised either by a rope or by a petro forge or by a piston and cylinder arrangement in which the cylinder is attached to the frame 14 and the piston is attached to the pivotal connection between the links 16 and 20.

In another alternative embodiment for raising the weight, part of the frame 14 comprises a cylinder and part of the weight 22 comprises a piston and the weight is driven upwardly by compressed air operating on the piston and cylinder and may, optionally, also be assisted in its downward movement by compressed air. In this embodiment the weight has a mass of 0.5 tonnes.

In another embodiment, parts of the weight comprise a cylinder and parts of the frame 14 comprises a piston.

In still further embodiments of the invention, the links 16 and 20 are variously replaced by a lazy tongues mechanism, a rope, or a chain having pivotally interconnected links.

In yet a further embodiment of the present invention the weight 22 is guided by suitable guide rods attached to the frame 14 and the weight is retarded and the resulting high force is transmitted by a brake interposed between the guide rods and the weight 22.

Figure 3:
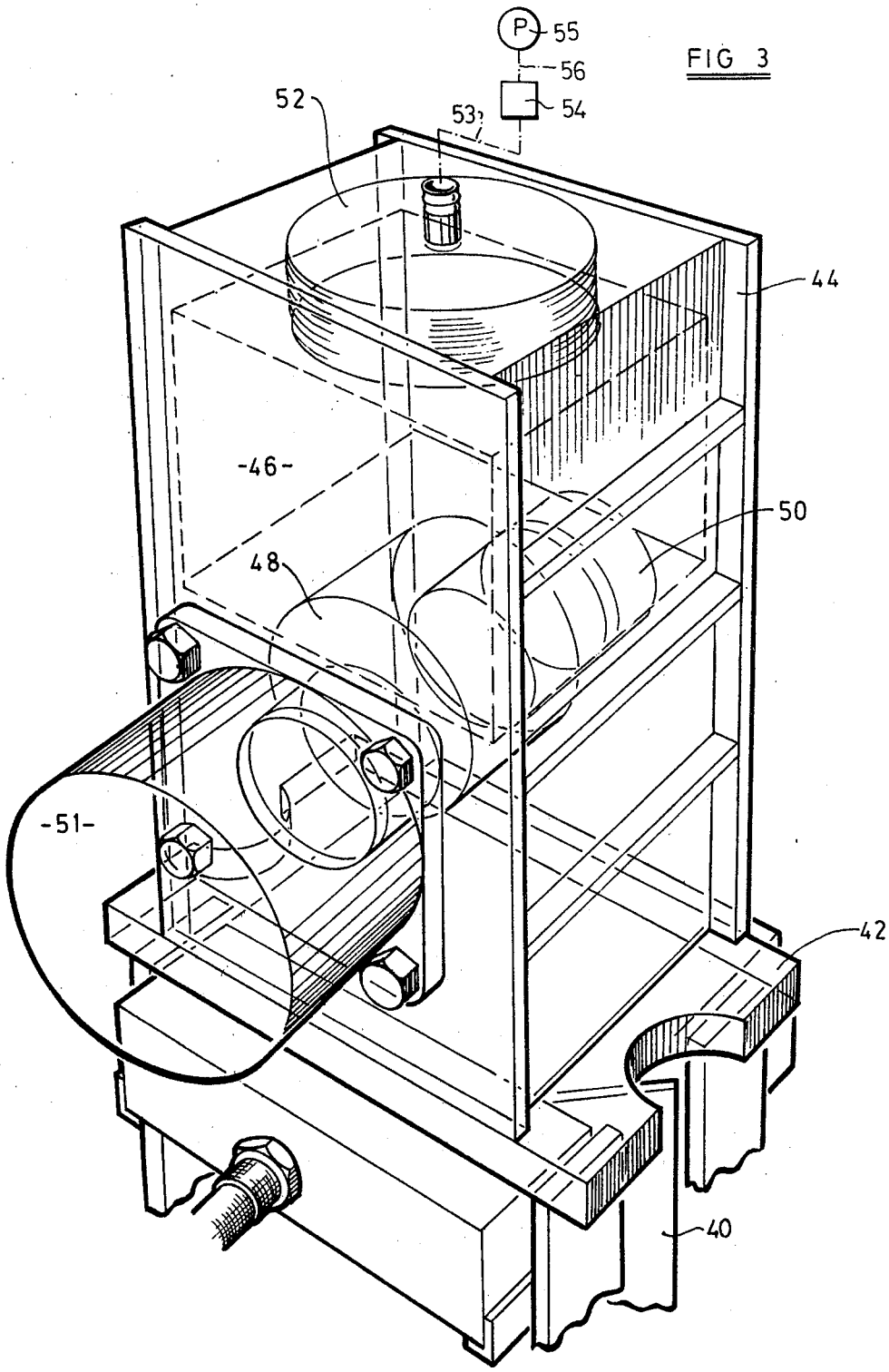
FIG. 3 is a perspective view of a pile driver of a third embodiment of the present invention.

Referring now to FIG. 3, in the pile driver there illustrated a pile 40 is attached to a driving member 42 which is mounted at the lower end of a frame 44.

A weight 46 is mounted for reciprocating movement in a vertical direction in the frame 44 and is driven upwards by a circular cam 48 fixedly and eccentrically mounted on a shaft 50 driven by a motor 51.

The weight 46 is assisted in its downward movement by bellows 52 which are supplied with compressed air through a conduit 53. The flow of compressed air is controlled by a valve 54 which is supplied with compressed air from a source 55 through a further conduit 56.

During operation, the weight 46 is first driven upwardly by the cam 48. Then, upon further rotation of the cam 48, the weight 46 is permitted by the cam to fall downwardly and is assisted in this downward movement by the action of the bellows 52.

During the last part of the downward movement, the weight 46 will be suddenly retarded by the cam 48 and the high force resulting from this sudden retardation will be transmitted from the weight 46 through the cam 48, the driven shaft 50, the frame 44, and the driving member 42 to the pile 40.

As in the case of the pile driver shown in FIG. 1, this high force will cause the pile 40 to be driven into the ground providing there is not excessive resistance.

The shaft 50 will be continuously rotated thereby causing continuous reciprocation of the weight 46 and the rotation will be continued until the pile 40 has been driven into the ground by the desired amount.

During rotation of the shaft 50, the cam 48 will remain in contact with the cam with the result that the high force arising from the retardation of the weight will be transmitted from the weight 46 to the driving member 42 without a substantial amount of noise being generated.

In this embodiment of the invention the weight 46 can be reciprocated at speeds up to 500 reciprocations per minute.

In another embodiment of the invention, the pile driver shown in FIG. 2 is modified by omitting the bellows 52.

All the embodiments of the invention hereinbefore described have the common feature that a weight is reciprocated and, at a certain stage during each complete reciprocation, is suddenly retarded. The high force resulting from this sudden retardation is transmitted to a pile through solid members, for example the links 16 and 20, the frame 14 and the driving member 10 of FIG. 1, or the cam 48, the driven shaft 50, the frame 44 and the driving member 42 of FIG. 3, and the solid members are all in engagement with each other for the complete duration of the sudden retardation with the result that the high force is transmitted without generating a substantial amount of noise.

In one further embodiment of the present invention, not illustrated, the weight is retarded and the resulting high force is transmitted to the driving member, electromagnetically.

In this further embodiment, as in all the other embodiments hereinbefore described, the high force resulting from the sudden retardation of the weight is transmitted without an impact occurring and so this high force is transmitted without substantial noise.

Although the embodiments of the present invention hereinbefore described all relate to pile drivers, it is to be appreciated that the present invention could also be used in other apparatus which apply a high force to an object, such as drop forging apparatus or concrete breaking appatatus.

In the foregoing specification and claims the term "impact" is defined as collision between two surfaces in which force is transmitted as a result of the collision between the surfaces in the direction of the relative movement between the surfaces immediately prior to the collision.

What we claim then is:

1. An apparatus for applying a high force to an object, such apparatus comprising:

a. a frame, b. a driving member mounted on the frame and adapted to engage the object, c. a weight mounted on the frame for reciprocating movement relative thereto, and d. means for causing the weight to perform said reciprocating movement including means to cause sudden retardation of the weight at one stage during each complete reciprocation, the high force arising from the sudden retardation being transmitted from the weight to the object without impact, as herein defined.

2. Apparatus according to claim 1 wherein the object comprises a pile.

3. An apparatus for applying a high force to an object, such apparatus comprising:

a. a frame, b. a driving member mounted on the frame and adapted to engage the object, c. a weight mounted on the frame for reciprocating movement relative thereto, and d. means for causing the weight to perform said reciprocating movement including means to cause sudden retardation of the weight at one stage during each complete reciprocation, the high force arising from the sudden retardation being transmitted from the weight to the object without impact, as herein defined by means of a number of solid members for transmitting said high force from the weight to the object, the solid members being in engagement with each other the weight and the driving member at least immediately prior to and for the duration of the sudden retardation.

4. An apparatus according to claim 3 wherein the weight is reciprocated along a straight vertical path.

5. An apparatus according to claim 4 wherein the apparatus further comprises:

a. fluid operated bellows for driving the weight in an upward direction.

6. An apparatus according to claim 4 wherein the apparatus further comprises:

a. means for driving the weight downwardly.

7. An apparatus according to claim 4 wherein the sudden retardation occurs only once during each complete reciprocation of the weight and commences just before the weight reaches its lowermost position on its downward descent.

8. An apparatus according to claim 4 wherein the apparatus further comprises:

a. a shaft rotatably mounted on the frame, b. a motor drivingly connected to the shaft, and c. a cam mounted on the shaft and adapted to raise the weight.

9. An apparatus according to claim 8 wherein the force resulting from the sudden retardation is transmitted from the weight through the cam and the shaft to the driving member.

10. An apparatus for applying a high force to an object, such apparatus comprising:

a. a frame, b. a driving member mounted on the frame and adapted to engage the object, c. a weight mounted on the frame for reciprocating movement relative thereto, and d. means for causing the weight to perform said reciprocating movement including means to cause sudden retardation of the weight at one stage during each complete reciprocation, the high force arising from the sudden retardation being transmitted from the weight to the object without impact, as herein defined, wherein the weight is reciprocated along a straight vertical path and wherein the apparatus further comprises an assembly of pivotally interconnected links pivotally connected to the frame and the weight.

11. An apparatus according to claim 10 wherein all the pivotally interconnected links are in tension during transmission of said high force.

12. An apparatus according to claim 10 wherein at least one of the links is in compression during transmission of the high force.

13. A method for applying a high force to an object comprising:

a. reciprocating a weight, b. suddenly retarding the weight at one stage during each complete reciprocation, and c. transmitting the high force resulting from the sudden retardation of the weight from the weight to the object without impact, as herein defined.

14. A method according to claim 13 wherein the high force is transmitted along a force path which passes solely through solid members, the solid members being in engagement with each other, the weight, and the object at least immediately prior to and for the duration of the sudden retardation.

* * * * *